United States Patent [19]

Straslicka

[11] Patent Number: 4,489,468

[45] Date of Patent: Dec. 25, 1984

[54] METHOD OF PROVIDING A MULTIVALVE TURBINE NOZZLE RING INTERFACE SEAL

[75] Inventor: William A. Straslicka, Norvelt, Pa.

[73] Assignee: Elliott Turbomachinery Co., Inc., Jeannette, Pa.

[21] Appl. No.: 392,857

[22] Filed: Jun. 24, 1982

[51] Int. Cl.[3] ..... B21K 3/00; B23P 15/04

[52] U.S. Cl. ..... 29/156.8 R; 29/156.8 CF; 29/445; 29/525; 29/DIG. 26; 415/190; 415/202; 416/193 A; 416/220 A

[58] Field of Search ..... 29/156.8 R, 525, 156.8 CF, 29/445, DIG. 26; 415/185, 189, 190, 202; 277/53; 416/193 A, 220 R, 220 A, 221

[56] References Cited

U.S. PATENT DOCUMENTS

| | | | |
|---|---|---|---|
| 1,619,133 | 3/1927 | Kasley | 416/220 R |
| 2,621,603 | 12/1952 | Thomas | 29/156.8 R |
| 2,656,146 | 10/1953 | Sollinger | 416/220 R |
| 2,674,134 | 4/1954 | Rigg | 277/53 |
| 2,935,296 | 5/1960 | Hockert et al. | 416/220 R |
| 2,945,290 | 7/1960 | Walsh | 29/156.8 R |
| 2,953,348 | 9/1960 | Leland | 416/221 |
| 3,700,354 | 10/1972 | Memery | 416/221 |
| 3,734,697 | 5/1973 | Sieghartner | 29/525 X |
| 3,893,233 | 7/1975 | Glover | 29/525 X |
| 3,952,395 | 4/1976 | Crossman et al. | 29/525 X |
| 4,207,004 | 6/1980 | Hold et al. | 277/53 X |
| 4,357,744 | 11/1982 | McKenzie et al. | 29/525 X |
| 4,389,161 | 6/1983 | Brumen | 416/220 R |

*Primary Examiner*—Charlie T. Moon
*Assistant Examiner*—Ronald S. Wallace
*Attorney, Agent, or Firm*—Robert P. Hayter

[57] ABSTRACT

The clearance necessary for the assembly of the nozzle ring of an axial flow steam turbine is localized through a temporary bolting. The localized clearance is compartmentalized by making a generally radially extending hole centered on the clearance at the circumferential location of the boundary between each pair of adjacent nozzle banks. Pins are driven into the holes and provide a seal between adjacent nozzle banks.

1 Claim, 6 Drawing Figures

METHOD OF PROVIDING A MULTIVALVE TURBINE NOZZLE RING INTERFACE SEAL

BACKGROUND OF THE INVENTION

This invention relates to a method and apparatus for sealing between the nozzle banks of an axial flow steam turbine.

Various valve arrangements are used to control the admission of steam into steam turbines. In one arrangement, the bottom wall of the steam chest is formed with a plurality of steam passages, each leading to a bank of steam nozzles. A precision machined seat is mounted in each passage. A valve is vertically movable into and out of engagement with each seat to control the admission of steam from the steam chest through the passages to the nozzle banks.

As the demand load on the turbine increases, the valves are moved upwardly from their seats in a predetermined sequential order, under the control of a governor, by a valve lift bar which is mounted in the steam chest above the series of seats for movement toward and from the same. The lift bar is formed with an aperture vertically aligned with each valve seat. Each valve has a stem that extends upwardly through an aperture and is slidable in the aperture. The upper end portions of the valve stems are threaded to receive stop nuts. When the lift bar is moved upwardly, it engages the stop nuts on the valve stems, and moves the valves upwardly from their seats. The sequence in which the valves are moved from their seats and the extent of such movement and hence the opening sequence of the nozzle banks is determined by the position of the stop nut on each of the valve stems.

The lift bar is reciprocated vertically in the steam chest by a servomotor which is controlled by the governor, whereby the valves are opened and closed sequentially according to the load demand on the turbine. The sequential, rather than simultaneous, operation is employed to provide for the admission of steam to selected banks of nozzles in a predetermined order for more efficient turbine operation and for better balance with minimum vibration. Accordingly, upon initial upward movement of the lift bar, a valve having its stop nut adjusted close to the lift bar will be first moved to open position. The valve of the series having the stop nut on its stem adjusted to a higher position will open upon further upward movement of the lift bar, and so on. With the lift bar in its uppermost position, all of the valves are open and all of the nozzle banks are being fed, and, as the lift bar is moved downwardly, the valves and their associated nozzle banks are closed in reverse sequential order.

In high pressure steam turbine applications, a nozzle ring bolted to a multivalve steam end casing is highly undesirable. This is because bolts break due to the higher steam temperature and pressure and, additionally, require more radial space thereby limiting the maximum rotor shaft diameter required to maintain a desired critical speed. The ideal attachment is a rolled in nozzle ring secured in a groove machined in the casing to produce a tee-shaped tongue-and-groove relationship. However, to assemble this type of nozzle ring, a clearance must be provided. When the nozzle is assembled, this clearance is a leakage flow path which permits the steam to leak into the adjoining valve chambers and nozzle banks within the casing.

SUMMARY OF THE INVENTION

In a split turbine casing, each half is provided with a semicircular groove of a shape such as to form an interlocking joint of the dovetail type with a complementary shaped projection on the nozzle ring. The nozzle ring is also split with lapped ends and with a projecting member on each half complementary to the corresponding groove in the turbine casing. The projecting member of each half of the nozzle ring is inserted into the complementary groove in the corresponding casing half and moved through 180°. To permit this sliding insertion, it is obvious that a resonable clearance must be provided for assembly. Although bolts are not acceptable in the operative turbine because of interference with turbine hardware, the nozzle ring segments are pulled into positive contact with the normal seal surface at the interface of the nozzle ring and the steam end casing ribs by means of removable bolts. This localizes the clearance between the nozzle ring and casing. A radially extending hole whose center is through the resulting clearance is machine partly in the nozzle ring and partly in the casing at the boundary between each adjacent pair of nozzle banks. The depth of the holes is greater than that of the nozzle seal surface. Cylindrical rods or pins are force fit into each hole and provide seal surfaces which isolate one valve chamber and nozzle bank from the adjoining one.

It is an object of this invention to provide a method and apparatus for providing a fluid seal between the adjacent valve chambers and nozzle banks of an axial flow steam turbine.

It is a further object of this invention to provide a seal for the nozzle ring of an axial flow steam turbine. These objects, and others as will become apparent hereinafter, are accomplished by the present invention. Basically, the clearance necessary for assembly of the nozzle ring of an axial flow steam turbine is localized through a temporary bolting. The localized clearance is compartmentalized by making a generally radially extending hole centered on the clearance at the circumferential location of the boundary between each pair of adjacent nozzle banks. Pins are driven into the holes and provide a seal between adjacent nozzle banks.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
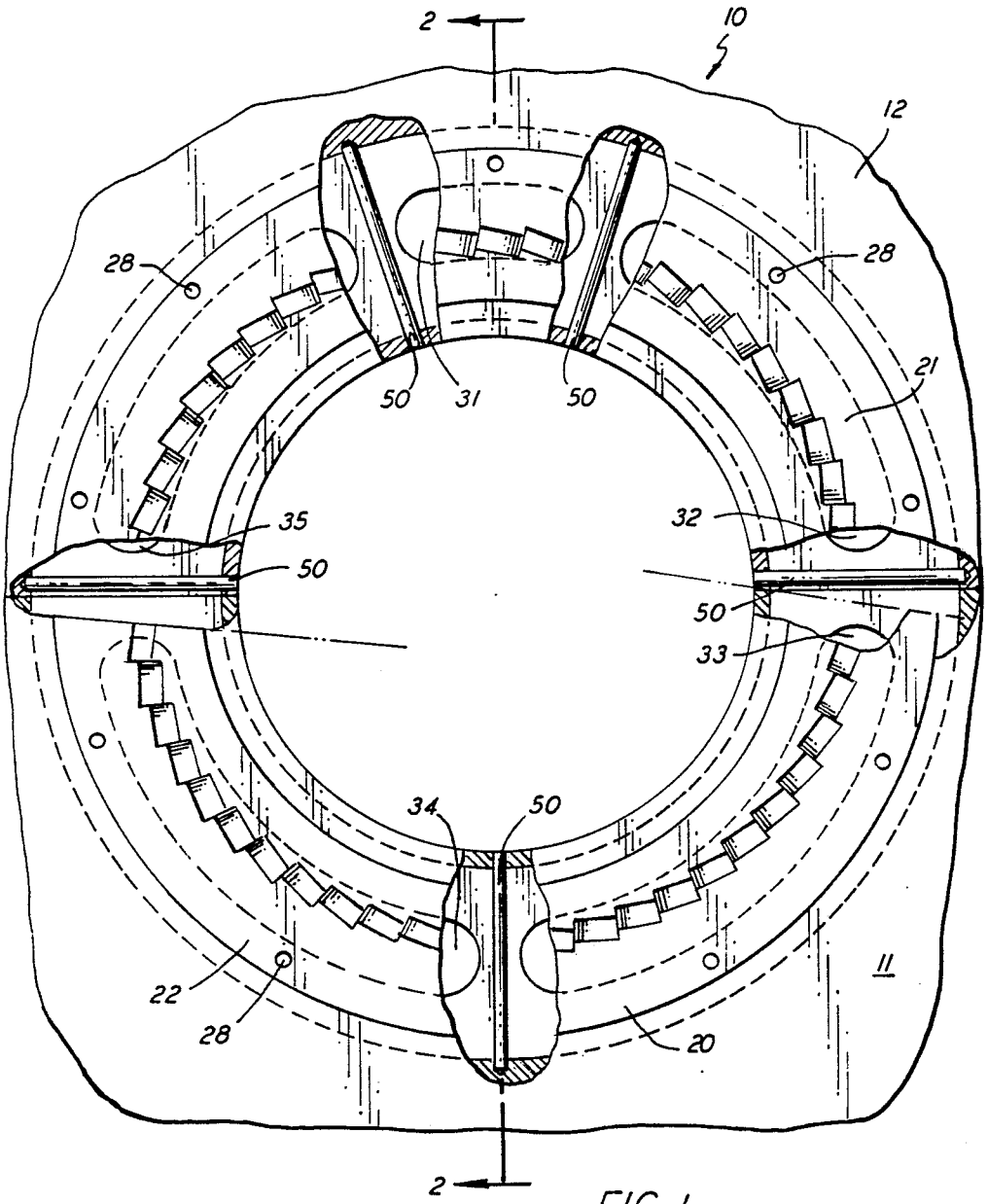
FIG. 1 is a partially sectioned view looking along the axis of the turbine.
Figure 2:
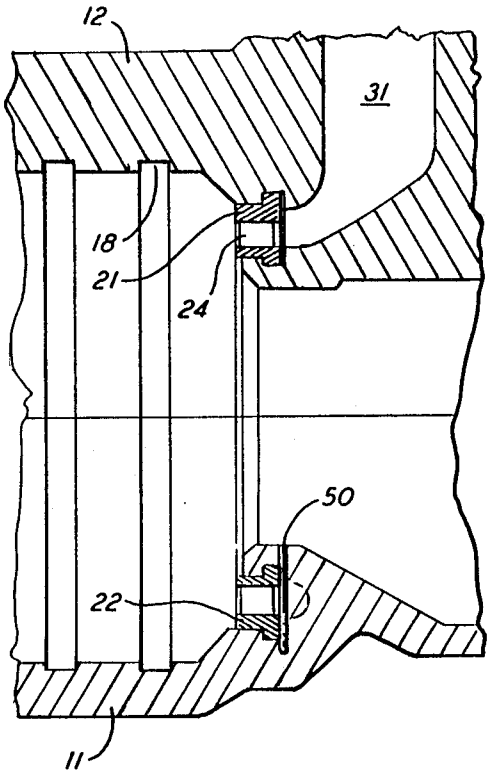
FIG. 2 is a partial vertical section taken along line 2—2 of FIG. 1.

In FIGS. 1 and 2 the numeral 10 generally designates an axial flow steam turbine having a horizontally split casing including a lower section 11 and an upper section 12. The casing sections 11 and 12 are secured together by bolts, or the like, (not illustrated). In the illustrated device, the split lap ended nozzle ring 20 is made up of sections 21 and 22 and is located downstream of a series of arcuate ports 31, 32, 33, 34 and 35. As is conventional, steam is supplied in the operating device to one or more of the ports 31–35 under the control of a governor (not illustrated) and passes between the blades 24 of the nozzle ring 20 and is then supplied to the turbine rotor buckets (not illustrated).

Figure 3:
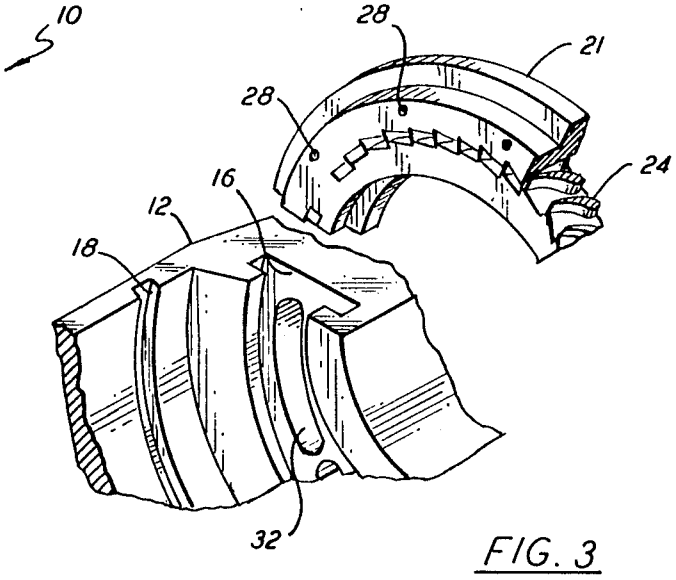
FIG. 3 is a partial pictorial view showing the inserting of the nozzle ring.
Figure 6:
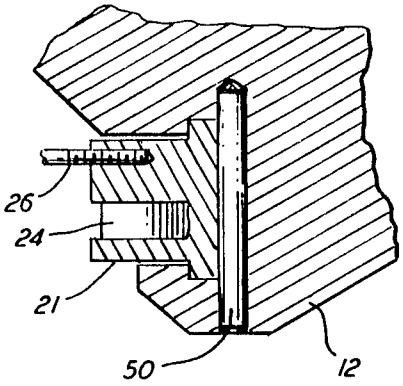
FIG. 6 is a partial sectional view showing a pin in place.
Figure 5:
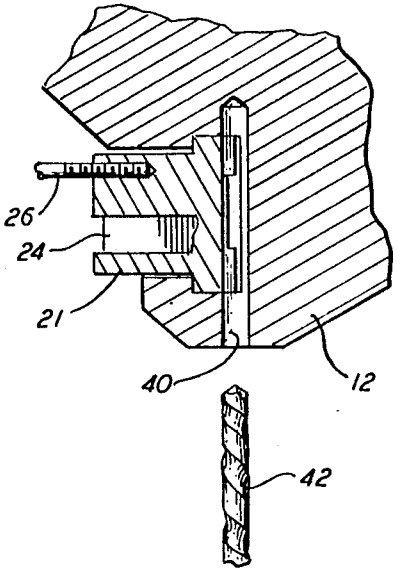
FIG. 5 is a partial sectional view showing the drilling of the hole.
Figure 4:
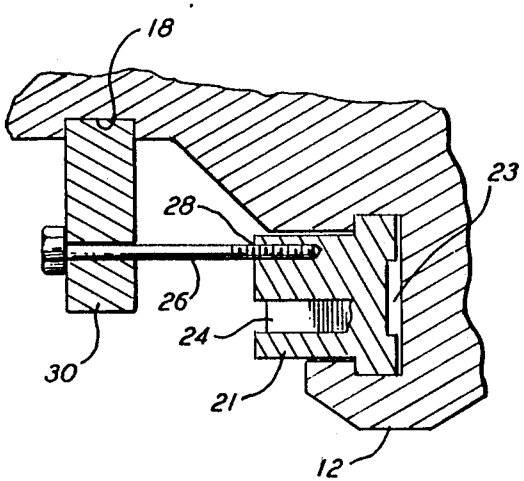
FIG. 4 is a partial sectional view showing the localized clearance.

The insertion or assembly of nozzle ring sections 21 and 22 in casing sections 12 and 11, respectively, is essentially the same except for the location of the nozzle banks corresponding to ports 31–35. The two nozzle ring sections 21 and 22 are matched at the casing horizontal split. Each section is accurately positioned radially in the respective half turbine casing so that a metal to metal contact exists at final unit assembly. As best shown in FIG. 3, nozzle ring section 21 is inserted into slot 16 of casing section 12 and is rotated through 180° so as to be coextensive therewith. Obviously, the insertion of the nozzle ring sections 21 and 22 in their corresponding casing sections 12 and 11, respectively, requires clearance between the members during assembly. As best shown in FIG. 4, the nozzle ring section 21 is positioned by bolts 26 which are received in tapped holes 28 in nozzle ring section 21 and are supported by half ring 30 which is received in diaphragm groove 18 of casing section 12 such that the clearance between sections 21 and 12 is localized upstream of the nozzle ring section 21 to define a chamber 23 which would be annular in an assembled turbine and would provide fluid communication to all of the nozzles formed by blades 24 if any of the nozzle banks were being supplied with steam. With nozzle ring section 21 positioned as illustrated in FIG. 4, a radially outwardly extending hole is drilled at each circumferential location marking the boundary between adjacent nozzle banks. As best shown in FIG. 5, the radially outwardly extending hole 40 is drilled out by drill 42 and is generally centered on chamber 23 and extends into both nozzle ring section 21 and casing section 12. Referring now to FIG. 6, pin 50 is driven into hole 40 in a force fit and thereby prevents fluid communication across the pin 50. The procedure sequentially illustrated in FIGS. 4–6 is repeated at each nozzle bank boundary location in casing sections 11 and 12. The casing sections 11 and 12 are then assembled to achieve the FIG. 1 device wherein the chamber 23 is compartmentalized by pins 50 so as to be coextensive with nozzle banks corresponding to ports 31–35 and to prevent leakage between nozzle banks.

Although a preferred embodiment of the present invention has been illustrated and described, other changes will occur to those skilled in the art. For example, the pins 50 could be located on the downstream side of the nozzle ring. It is therefore intended that the scope of the present invention is to be limited only by the scope of the appended claims.

What is claimed is:

1. A method for sealing assembly clearances between a casing and a member of a turbomachine, said casing defining a groove into which the member is slidably mounted comprising the steps of:

(a) inserting a portion of the member subject to a pressurized fluid, into the groove defined by the casing;

(b) localizing the assembly clearances between the member and the casing into a single clearance by forcibly displacing the member against a wall of the groove leaving a single remaining clearance between the member and an opposite wall of the groove;

(c) making a hole in the displaced member and casing generally centered in the single clearance and of a depth and diameter greater than the height of the clearance at a location between the member and the opposite wall of the groove;

(d) driving a pin in a force fit relationship into the hole to prevent fluid communication across the pin; and (e) repeating steps (c) and (d) in the space having pressurized fluid therein, said space being between the member and the opposite wall of the groove.

* * * * *